United States Patent [19]

Metz et al.

[11] Patent Number: 4,469,510

[45] Date of Patent: Sep. 4, 1984

[54] METHOD OF AND APPARATUS FOR THE DIRECT PRODUCTION OF MOLTEN IRON

[75] Inventors: Paul Metz; Edouard Legille, both of Luxembourg; François Schleimer, Esch; Antoine Weiner, Luxembourg, all of Luxembourg

[73] Assignee: Arbed S.A., Luxembourg, Luxembourg

[21] Appl. No.: 370,501

[22] Filed: Apr. 21, 1982

[30] Foreign Application Priority Data

Apr. 22, 1981 [LU] Luxembourg ..... 83313

[51] Int. Cl.[3] ..... C21C 7/00

[52] U.S. Cl. ..... 75/51; 75/52; 75/60; 266/280

[58] Field of Search ..... 75/51–59, 75/60

[56] References Cited

U.S. PATENT DOCUMENTS 4,089,677 5/1978 Spencely ..... 75/60

4,329,171 5/1982 Robert ..... 75/60

*Primary Examiner*—P. D. Rosenberg

*Attorney, Agent, or Firm*—Karl F. Ross; Herbert Dubno

[57] ABSTRACT

A method of producing molten iron in which iron oxide is fed together with carbon to an oxygen-top-blown melt from below through blocks whose pores permit the particles to be entrained into the melt in a carrier gas, the pores preventing penetration of the molten metal.

5 Claims, 1 Drawing Figure

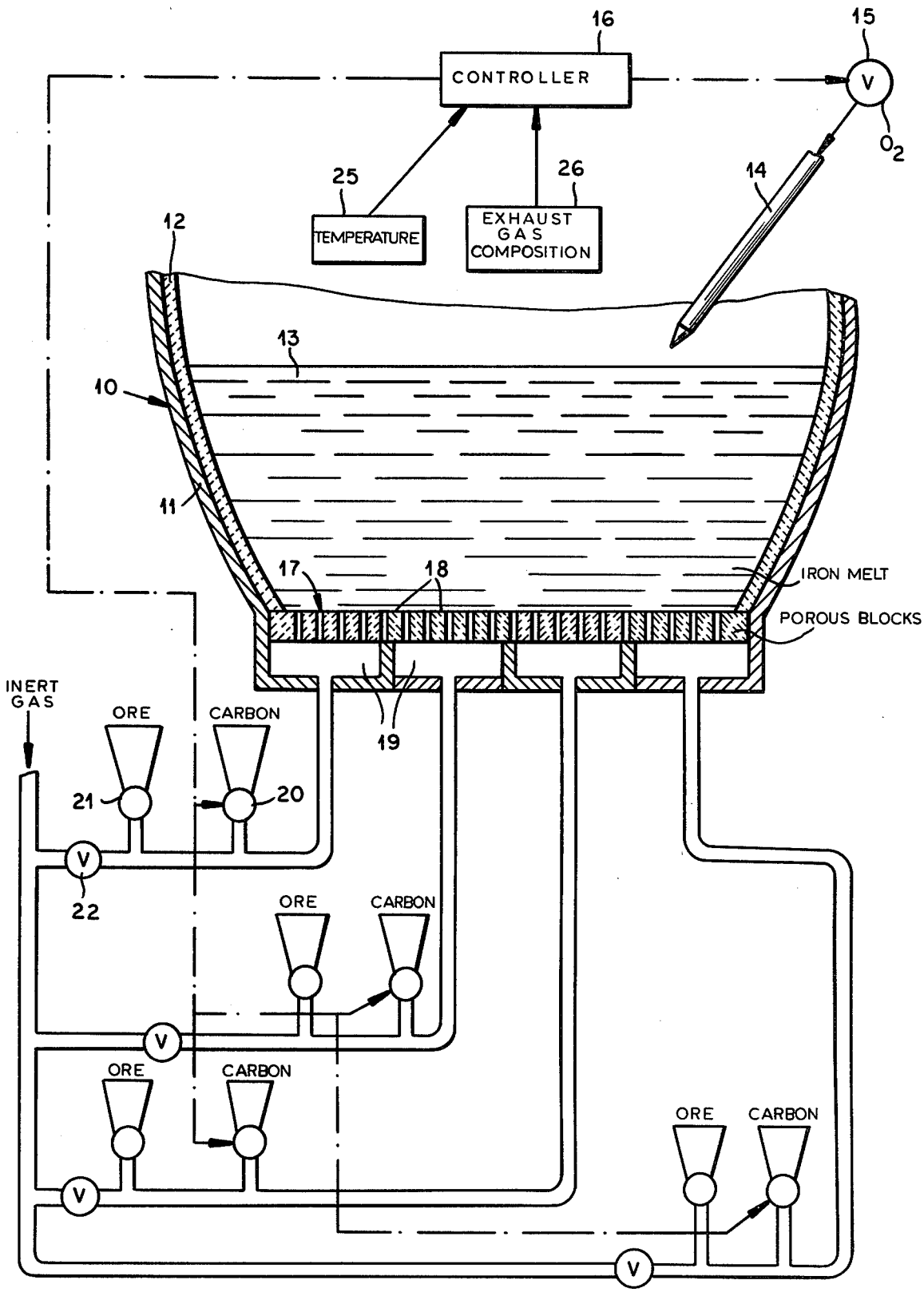
16
15
CONTROLLER
V
$O_2$
25
26
14
TEMPERATURE
EXHAUST GAS COMPOSITION
12
13
10
11
17
18
IRON MELT
POROUS BLOCKS
INERT GAS
ORE
CARBON
19
21
20
V
22
ORE
CARBON
V
ORE
CARBON
ORE
CARBON
V
V

METHOD OF AND APPARATUS FOR THE DIRECT PRODUCTION OF MOLTEN IRON

FIELD OF THE INVENTION

Our present invention relates to the production of molten iron, and, more particularly, to the direct production of molten iron from iron ore and other oxidic iron compounds. The invention is especially directed to the simultaneous reduction and smelting of iron from the oxidic state.

BACKGROUND OF THE INVENTION

While indirect methods of producing molten iron (pig iron) from iron oxide material, e.g. iron ore, have been utilized for generations, in recent decades considerable emphasis has been placed on the direct production of molten iron from iron oxide.

The indirect approach is or can be differentiated from the direct approach in that the indirect approach requires numerous treatments before reaching the stage of molten iron. Generally these stages involve treatment with slags or the presence of slags.

In the direct method, the iron oxide ore or other oxidic iron-containing material can be directly reduced to elemental iron which can be smelted.

For example, in one direct method, the iron ore materials are treated with reducing gases and are thereby transformed into sponge iron. The latter is then smelted in a metallurgical vessel. In the smelting vessel a reaction is carried out between the metal and oxygen-containing gases whereby the oxygen from the gases reacts with carbon and carbon-containing substances, generally by blowing beneath the surface of the melt, thereby producing carbon monoxide and possibly, thermal energy.

The exothermically produced heat is partially utilized to smelt the sponge iron, and the waste gas from the process is utilized for the direct reduction of the ore. In general, the latter step can only be effected if all of the exhaust gas from the earlier step is reacted in a separable reactor with coal dust and steam.

In another prior art process, a combined smelting and gas generating reactor is used and is provided with an additional heat source. The fuel is reacted with oxygen to produce a reducing gas in this reactor and, within another compartment of the reactor, the reducing gas is passed in counterflow to the ore, the pre-reduced ore at the end of the reducing stage being then fed to the heated smelting and gas generating compartment in which the melt is formed and refined.

Another system for the direct production of pig iron utilizes two separate feed and reaction zones in smelting and gas generating reactors.

In a first zone, a carbon content above about 2% is maintained in the metal melt to which a carbon carrier is directly fed to this zone.

In a second zone, oxygen is reacted with a portion of the carbon contained in the melt to liberate heat and reducing gases. Carbon is fed into the system by an immersion lance which is plunged below the surface of the melt, to increase the carbonization of the iron bath and thus promote the smelting capacity and the formation of reducing gases.

In all of the afore-described systems, a principal phase in the operation is the production of a reducing gas which is utilized at least for the prereduction of the ore and even for the primary reduction thereof.

However, the production of reducing gases for these purposes requires excessive and complex control and measuring systems so that the reducing gas will have the correct composition.

Indeed, control is simplified by the separate production of the reducing gas, although this results in a significant increase in both the capital and operating costs.

In the face of these problems with the separate production of reducing gases and/or the complex regulation of the composition thereof, the assignee, in earlier work in this field, reflected in Luxembourg patent LU No. 82.227, for example, proposed a method for the direct production of molten pig iron in a single vessel whereby these disadvantages could be obviated. Specifically, the carbon carrier was blown directly by a neutral or reducing carrier gas and saturated with carbon. The iron oxide is deposited upon the bath surface and around the pile of iron oxide an oxygen blast is generated. The bath is agitated and maintained in flux by the continuous movement of gas upwardly through the bath from passages in the refractory bottom, i.e. blowing blocks which are gas permeable.

Surprisingly, it is found to be possible in this manner, i.e. by the top blowing of the carbon saturated bath with oxygen and the bottom bubbling of inert gas, to control the composition of the reducing gas formed above the surface of the melt and utilized for prereduction of the ore.

In practice it has been found that the gases produced at the surface of the melt can contain practically 100% carbon monoxide and thus have an extremely high reduction potential. The carbon monoxide concentration can be controlled by regulating the oxygen feed and the sparging of the bath with the inert gas such that the carbon monoxide content is increased with reduced bubbling of the sparging gas through the melt.

For example, the sparging of the bath with the inert gas can be reduced to 0–0.1 standard cubic meters of the inert gas per ton of melt per hour.

When it is desired to increase the thermal energy evolved at the surface of the melt, i.e. promote the reaction whereby carbon monoxide exothermically reacts with oxygen to produce carbon dioxide, the sparging gas flow can be increased and can reach amounts of 0.1–0.3 standard cubic meters of inert gas per ton of the melt per hour.

This additional heat facilitates smelting of the iron ore.

With this latter technique, however, the problem arises that a portion of the ore will become incorporated in the slag and will not be subjected to reduction.

This can be avoided by introducing the ore and the carbon by means of an immersion lance into the melt. Naturally this creates other problems, since such immersion lances are subject to wear, are expensive, and require space consuming and high maintenance manipulators and the like.

Bottom nozzles have also been provided to permit carbon and ore to be carried into the melt. Such bottom nozzles, as with immersion lances, are subject to a high degree of wear, are generally not long lived, are composed of expensive material and require frequent replacement and maintenance at high cost. The bottom nozzle generally must be supplied with gas continuously to prevent the penetration of metal from the bath into the passages of these nozzles. As a consequence, the consumption of the gases, which generally are not inexpensive, can be excessive.

OBJECTS OF THE INVENTION

It is the principal object of the present invention to provide a method of producing molten iron from a solid oxidic material which can facilitate the supply of this material to the bath, provide a relatively long contact time between the reactive and heat-exchanging material and thus ensure a sufficient production of the pig iron.

Another object of this invention is to provide a method for the production of molten iron which has a higher degree of flexibility than earlier systems with respect to changes in the gaseous and solid materials which are utilized and thus avoid unnecessary consumption of gas.

It is also an object of this invention to provide a method of forming an iron melt which does not require expensive and space-consuming equipment.

SUMMARY OF THE INVENTION

These objects are attained, in accordance with the invention, in a method which comprises the steps of forming an iron melt, topblowing this melt with oxygen and simultaneously feeding iron oxide suspended in a gas into the melt from the bottom with, if desired, carbon carrying substances. The iron oxide and carbon carrying substances can be fed from below, therefore, selectively (individually) or in combination by one and the same charging apparatus which can include a refractory bottom block provided with oriented passages such that the passages are gas and particle permeable without being able to pass the liquid metal, the gas and solid feed being interruptible, selectively switchable into operation and controllable as to flow rate.

The present invention thus directly reduces and smelts the iron ore by blowing it, in a carrier gas together with carbon carrying substances, or prior to the similar blowing of carbon-carrying substances or after the blowing of carbon-carrying substances into the melt through refractory blocks of the type described, so that the exothermic reaction generates part of the heat required to smelt the elemental iron which is formed in the three-zone reaction which is maintained where the carbon-carrier gas, particulate and melt meet. Additional heat is delivered to the melt by topblowing of oxygen onto the surface, the oxygen reacting with excess carbon. This topblowing does not require an immersion lance with its complex spatial needs or sensitivity to wear.

An important advantage of the present invention is that it does not use either the complex bottom-blowing nozzles heretofore required nor the immersion lances which have hitherto been utilized and hence also eliminates the need for the constant flow of inert gas upwardly through the melt.

In part the invention is based upon our discovery that the bottom block can be utilized to deliver finely divided particles to the melt in the carrier gas, i.e. iron oxide particles and carbon particles.

The bottom bubbling blocks may be formed from any desired refractory lining material for iron-handling metallurgical vessel, e.g. magnesia, alumina, zirconia and combinations thereof, the passages being formed by compacting the refractory around fibers of the desired diameter and then firing the block to burn away the fibers, leaving packages of the corresponding diameter. Nonfired blocks can also be used.

The particulates which can be introduced should merely have diameters less than the passage diameter. Thus, if the passages have diameters ranging from, say, 0.5 mm to about a micron, the solids may have a particle size in the submicron range.

The diameters of the passages should be selected so that the surface tension of the melt will prevent liquid percolation through the passages even in the absence of a gas stream.

Practically all of the heat required for maintaining the fluid state of the melt can be obtained by continuous or intermittent topblowing with oxygen, the topblowing being free from the drawbacks hitherto encountered when the iron oxide was disposed on the top of the melt or the iron thereon was freshly formed. The iron forming reaction in the present invention is effected initially at the bottom of the melt.

The pickup of carbon by the molten iron is a substantially endothermic reaction. The proportion of the carbon dissolved in the iron per unit weight or volume of carbon supplied decreases as the rate of feed of the cooling carrier gas increases. If one then wishes to saturate an iron melt with carbon or to supersaturate the melt with carbon, it is necessary to plan on a carbon concentration above 3% carbon and to consider a melt which consists of about 200 tons of iron in a vessel. To reach these concentrations, high excesses of carbon must be supplied together with large volumes of cooling or carrier gases. In addition, the iron ore is a cooling substance and the reduction of the ore to metallic iron requires energy. As a consequence, there are many energy consuming factors which interact when iron ore is transformed to molten iron in a melt, using a carrier gas by which the carbon material and the iron oxide are introduced into the melt. With the process of the present invention, the amount of carrier gas which is required can be significantly reduced, thereby limiting the thermal drain. Furthermore, the method of the invention allows the thermochemical relationships in the vessel to be comparatively easily controlled.

The exhaust composition from the bath can be continuously monitored and the bath temperature discontinuously determined. The reduction in the bath temperature can be used to control the rate at which the oxygen is fed to the bath for the topblowing. So-called hard oxygen jets can be directed onto the bath surface and the blowing lance can have this jet modified in accordance with requirements.

Should there be a reduced carbon monoxide concentration and increased carbon dioxide concentration in the exhaust gas, signaling insufficient carbon supplied to the latter, the controller can automatically operate the carbon feeder.

The ideal solids composition has been found to be about 70% by weight $Fe_2O_3$ and 30% by weight carbon, the finely milled solids being separately stored and being individually fed through the common charging device opening via the porous blocks into the bottom of the bath.

It has been found to be advantageous to provide the bottom of the bath with several charging units which will be individually or collectively controlled and which can feed the iron oxide, the carbon or mixtures of the two.

Naturally, if the endothermic contribution of any of these additions to the bath are excessive and cannot be compensated for by the oxygen blast at the top of the bath, the various materials can be fed at other locations where, for example, the bath is hotter. For example, carbon can be fed to the center of the vessel in which the bath is at a higher temperature.

Furthermore, the various components can be set at different levels based at bottom, e.g. through the wall of the vessel and exothermically acting solids or gases may be supplied to raise the local temperature at the location of which the materials are fed into the bath.

Preferably, the iron oxide has an average particle size of 50 microns and the pores of the blocks are dimensioned to pass these particles.

The use of finely divided solids has numerous advantages. For example, the solids are transported by carrier fluids in pipes and the pelletizing of the solids hitherto considered to be necessary in many metallurgical applications is eliminated. This reduces the production cost and the transport and storage costs as well.

The methods of the invention can be carried out in a converter for refining pig iron, formed with a lance for blowing oxygen and the charging unit. Each of the charging units can include porous blocks which lie adjacent to one another in contact along their longitudinal edges and composed of unburned (chemically bonded or carbon bonded) ceramic which are fired in place. The segments are formed with wear resistant coatings along at least one longitudinal surface and can be enclosed in a common metal housing sealing against the longitudinal flank of the segment.

Mortar seams can be provided to seal the block and a plenum chamber can be provided for each block which is connected to a respective feeding device.

The feeding or metering devices are preferably so-called cell-wheel feeders, e.g. as described in Luxembourg Pat. No. 80.692.

The gas permeable blocks can be made or constructed as described in Luxembourg Pat. Nos. 82.552, 82.553, 82.554 and 82.597.

BRIEF DESCRIPTION OF THE DRAWING

The above and other features and advantages of the present invention will become more readily apparent from the following description, reference being made to the accompanying drawing, the sole FIGURE of which is a diagrammatic section of the lower portion of a converter for carrying out the method of the present invention.

SPECIFIC DESCRIPTION

In the drawing we have shown a converter 10 whose steel shell 11 is provided with a refractory lining 12 and containing an iron melt 13.

This melt is top-blown by an oxygen lance 14 of the nonimmersion type, directing its blast onto the surface of the melt. The oxygen is fed to the lance 14 via a valve 15 operated by a controller 16. The bottom 17 of the converter is formed by a plurality of blocks 18, which have been shown only diagrammatically and may be constructed as described in the aforementioned Luxembourg patents.

These blocks 18 are each associated with a plenum chamber 19 and are in side relationship so that each block constitutes part of a charging unit.

Each charging unit can have a rotary cell metering device 20 for carbon and a metering device 21 for the iron oxide or a single metering device can be provided for both. The inert carrier gas, e.g. argon, is fed by a valve 22 to entrain the solids into the bottom of the converter.

The controller 16 has a temperature sensor or detector 25 and an exhaust gas composition monitor 26 both feeding the controller 16. When the bath temperature drops, the sensor or detector 25 responds to operate the controller 16 and the upper valve 15, thereby increasing the oxygen blast.

If a carbon deficiency is detected by the monitor 26, the controller 16 operates the metering device at 20 to increase the carbon feed to the bath.

Naturally, the feed of the iron oxide and/or carbon particles and of the inert gas can be interrupted when the desired amount of iron has been added to the melt. The molten iron can then be tapped or discharged, the balance of the iron retained to allow the process to be repeated, and the supply of iron oxide and carbon in the carrier gas begun again.

We claim:

1. A direct method for producing iron, comprising the steps of:

(a) forming a melt of molten iron;

(b) blowing into said melt at the bottom thereof inert carrier gas, particles of carbon entrained with said gas and particles of iron oxide entrained with said gas through refractory blocks of a permeability sufficient to permit the passage of said particles and said carrier gas but inherently preventing the flow of metal from the bath through said blocks;

(c) directing an oxygen blast against the upper surface of said melt; and (d) controlling the feed of said gas and said particles to said melt and interrupting the same in accordance with the amount of iron added to said melt.

2. The method defined in claim 1, further comprising the steps of continuously monitoring the composition of the exhaust gas from the surface of the melt and controlling the carbon introduced in said inert gas to increase the carbon so introduced upon an increase in the carbon dioxide content and a decrease in the carbon monoxide content of said exhaust gas.

3. The method defined in claim 2, further comprising the step of discontinuously monitoring the bath temperature and increasing the intensity at which the oxygen stream is directed onto the surface of said melt upon a decrease in bath temperature.

4. The method defined in claim 1 wherein a plurality of charging units feeds said inert gas and particles into the bottom of said melt and the charging units are controlled individually and collectively.

5. The method defined in claim 1 wherein said inert gas is capable of reacting exothermically with said melt.

* * * * *